United States Patent [19]

Rückl

[11] Patent Number: 4,928,593

[45] Date of Patent: May 29, 1990

[54] TENSIONING ROLLER, AND DEVICE PROVIDED WITH SUCH A TENSIONING ROLLER

[75] Inventor: Siegfried Rückl, Kufstein, Austria

[73] Assignee: Schablonentechnik Kufstein GmbH, Austria

[21] Appl. No.: 306,631

[22] Filed: Feb. 3, 1989

[30] Foreign Application Priority Data

Feb. 12, 1988 [NL] Netherlands ..... 8800354

[51] Int. Cl.[5] ..... B41F 27/00

[52] U.S. Cl. ..... 101/389.1; 29/113.1

[58] Field of Search ..... 101/389.1, 401.1, 375; 29/113.1; 242/72 B; 279/1 Q, 4

[56] References Cited

U.S. PATENT DOCUMENTS

| | | | |
|---|---|---|---|
| 2,621,867 | 12/1952 | Grettve | 29/113.1 |
| 2,711,863 | 6/1955 | Grettve | 279/4 |
| 4,030,415 | 6/1977 | Fellows | 101/389.1 |
| 4,089,265 | 5/1978 | White et al. | 101/389.1 |
| 4,150,622 | 4/1979 | Stollenwerk | 101/389.1 |
| 4,301,727 | 11/1981 | Bardin | 101/153 |
| 4,461,663 | 7/1984 | Tachibana et al. | 101/375 |

*Primary Examiner*—Eugene H. Eickholt

*Attorney, Agent, or Firm*—Lucas & Just

[57] ABSTRACT

Described is a tensioning roller which can expand under the influence of an inflating pressure and which is used for supporting a medium which is to be treated with high-energy radiation.

Such a tensioning roller comprises at the outside a thin walled metal cylinder or sleeve which for the purpose of achieving an increased radial expandability according to the invention is provided with axial slots which are evenly distributed around the periphery of the sleeve.

The invention also concerns a device for treating a medium with high-energy radiation which comprises a tensioning roller as described.

8 Claims, 3 Drawing Sheets

TENSIONING ROLLER, AND DEVICE PROVIDED WITH SUCH A TENSIONING ROLLER

BACKGROUND OF THE INVENTION

The invention relates to a tensioning roller for centred accommodation of a medium to be treated according to a pattern with high-energy radiation, at least comprising a central shaft around which is placed a supporting element for the medium to be treated, which is expandable in the peripheral direction and in the expanded state is arranged symmetrically round the shaft and, viewed in the radial direction going out from the shaft comprises a supporting cylinder, an inflatable bag made of elastic material, a thin-walled metal cylindrical sleeve disposed around it, centring means for centring said supporting cylinder, inflatable bag and cylindrical sleeve, and means for the supply and discharge of inflation medium for the inflatable bag.

Such a tensioning roller is generally known and is used, for example for designing rotary screen printing stencils.

Such a rotary screen printing stencil is formed by a thin-walled, seamless metal screen material, for example a nickel screen material, said screen material being coated with a light-sensitive coating composition. When pumped up, the rubber bag disposed inside the cylindrical screen gives the rotary screen printing stencil a suitable cylindrical shape, the fastening of the bag being such that the central shaft of the cylinder sleeve coincides with the central shaft of the supporting cylinder around which the inflatable bag is arranged. If a diapositive film is tensioned with the emulsion side lying against the light-sensitive coating present on the screen and is then exposed to ultraviolet radiation, the light-sensitive coating, for example a polyvinyl alcohol-/ammonium bichromate coating, is hardened, for example at the light-transmitting parts of the diapositive film, in such a way that it can no longer dissolve in water.

At the places where the coating has not hardened, i.e. where the coating has not been struck by actinic rays, for example ultraviolet radiation, the coating has not hardened, it can be removed using water. A negative picture of the positive pattern present in the film is formed in this way.

During printing which such a printing block, for example on a rotary screen printing machine, at all points of the screen which correspond to the blackened parts in the positive film printing compound is allowed through the screen, so that a positive print of the original positive pattern is formed on the surface of the substrate to be printed.

The element which in the above description of the tensioning roller corresponds to the medium to be exposed is in this case the light-sensitive coating present on the screen.

Of course, the supporting cylinder mentioned in the above description can also be a closed cylinder, and the device in which the tensioning roller is accommodated can be used for treating, say, a film material with light according to pattern.

Such a tensioning roller can also be used, for example, for burning open with a laser beam the perforations of a screen printing stencil material closed with a sealing lacquer.

In view of the metal nature of the cylindrical sleeve, such known tensioning rollers have an essentially fixed peripheral measurement which can be varied within narrow limits only by great variation in the inflation pressure applied.

For many applications a greater variation possibility would be desired, but a temporarily applied peripheral enlargement must not lead to permanent deformation of the material of the cylindrical sleeve.

The object of the present invention is to produce a tensioning roller of the type mentioned, but in which through variation of the pressure applied for the inflation medium the periphery of the cylindrical sleeve can be varied within considerably wider limits than has been the case hitherto.

SUMMARY OF THE INVENTION

The object indicated is achieved with a tensioning roller of the indicated type in which according to the invention the cylindrical sleeve is provided with slots extending essentially in the axial direction and uniformly distributed in the peripheral direction.

Through providing the cylindrical sleeve used with a number of slots uniformly distributed over the periphery, a peripheral expansion of the cylindrical sleeve used becomes possible, while no permanent deformation of the sleeve material occurs in normal use.

In particular, the slots in the wall of the cylindrical sleeve extend beyond the maximum width of a medium to be exposed which is to be supported by the cylindrical sleeve.

It is not necessary for the slots in the sleeve to extend over the full length of the sleeve. While maintaining the beneficial feature that the slots extend beyond the maximum width of the material to be exposed, one or more interruptions can be provided in each of the slots. The beneficial effect of the expansion facility indicated earlier without permanent material deformation is then retained.

If the slots do not extend over the entire length of the sleeve, it is not necessary for the partial slots to lie in line with one another; the partial slots can be staggered relative to each other in the peripheral direction, while the functioning of the tensioning roller is retained.

In order to prevent tearing of the slots when the cylindrical sleeve expands, at both ends of each slot, or at both ends of each slot part, perforations can be made in the material of the cylindrical sleeve with a smallest dimension, measured perpendicular to the direction in which the slot runs, which is greater than the width of the slot or part of a slot in question.

In general, it is advantageous if the perforation is a circular perforation in which:

Width of slot $\leqq$ D perforation $\leqq 10 \times$ Width of slot.

In a typical embodiment of a tensioning roller according to the invention the cylindrical sleeve is of a selected length and is formed by a seamless, electroformed nickel sleeve which has a wall thickness between 100 and 200 micrometers and has ten slots which are distributed over the periphery thereof and may or may not be interrupted in the axial direction, each slot or part of a slot being of a width lying between 50 and 2,000 $\mu$m and preferably between 250 and 500 $\mu$m.

The invention also relates to a device for treating a medium according to pattern with high-energy radiation, at least comprising a tensioning roller for carrying the medium to be treated, means for rotary driving of the said tensioning roller, a suitably set-up source of actinic radiation, and means for taking the tensioning roller into the expanded state prior to the exposure to light of the medium, so that said medium comes to rest rotationally symmetrically round the shaft of the tensioning roller, the tensioning roller being formed in such a device by a tensioning roller of the type described above which constitutes a subject of the present invention.

The above-described tensioning roller according to the invention can be used for stretching all kinds of media to be treated with light, for example a rotary screen printing stencil coated with light-sensitive lacquer, an offset plate material coated with light-sensitive lacquer, plastic film material provided with a light-sensitive emulsion etc.

The tensioning roller according to the invention is found to be particularly advantageous if the medium to be treated with high-energy radiation is a seamless, cylindrical metal rotary screen printing stencil in which the perforations of said stencil are sealed with a lacquer material. Such a lacquer material can be a non-light-sensitive lacquer material, in which case the light treatment consists of using a programmed laser beam to burn away said lacquer from the perforations in areas corresponding to those areas in which the screen material is required to be permeable.

For a description of the above-mentioned pattern-forming process using a programmed laser beam there is referred to PCT Patent Application WO 86/04549 filed by applicants.

It has been found that the above-described tensioning roller according to the invention exhibits such good revolution accuracy that any swing occuring remains within the in-focus path of a laser beam focused on the surface of the medium for treatment while the roller is at a standstill.

BRIEF DESCRIPTION OF THE DRAWING

The invention will now be explained with reference to the drawing, in which:

FIG. 1 shows a side view of an axial section of the roller according to the invention, and FIG. 1*a* and 1*b* show partial right and left side views of the roller.

FIG. 1 shows a tensioning roller 1 which is provided with a thin-walled cylindrical sleeve 2, the cylindrical sleeve 2 according to the invention being provided with slots 3 and having at the ends of each of the slots a perforation 5 whose dimension is greater than the width of any of the slots. The cylindrical sleeve 2 forming part of the tensioning roller 1 is fixed to the centring head 7, which is in turn carried by a centring sleeve 7'. The centring sleeve 7' is centred around the central shaft of the tensioning roller.

Figure 7A:
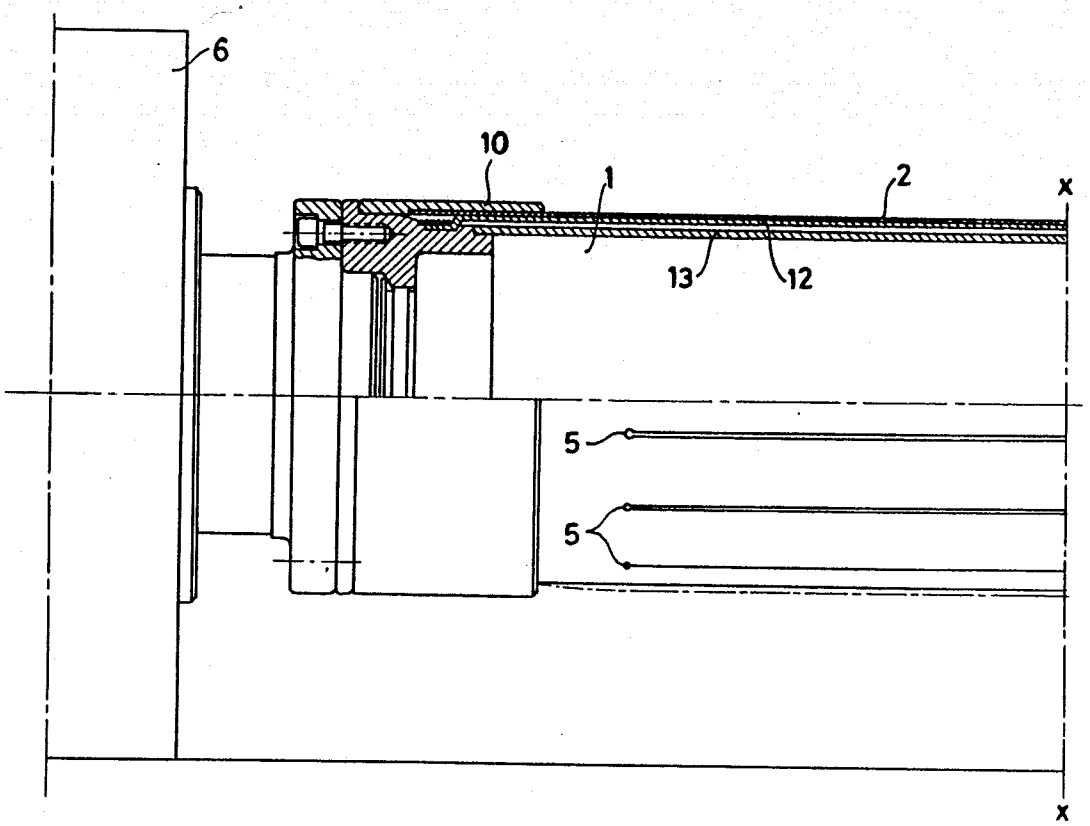
Figure 1B:
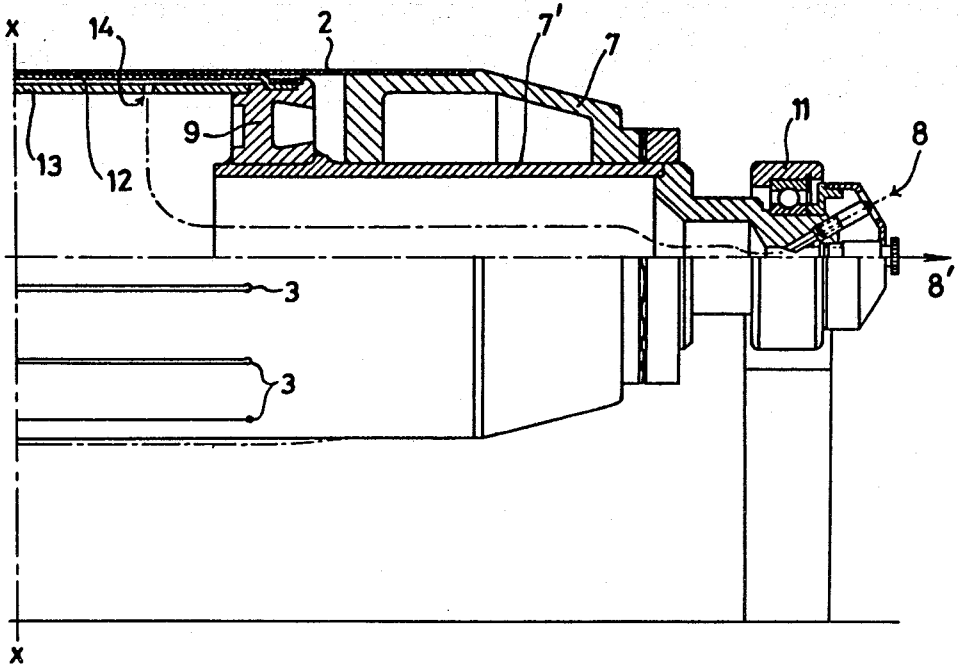

The centring sleeve 7' also has fitted on it a fastening 9 to which a supporting cylinder 13 provided with one or more inflation medium passages 14 is connected. An inflatable bag, for example an inflatable rubber bag 12, fixed in sealing fashion to the support 9, is provided between the supporting cylinder 13 and the cylindrical sleeve 2.

Reference numbers 8, 8' indicate an inflation medium inlet and outlet respectively, the path followed by the medium being indicated by a dashed line. If inflation medium, for example air, is fed in via 8, the rubber bag 12 is pushed vigorously against the inner surface of the cylindrical sleeve 2, which takes the cylindrical sleeve 2 into an excellently centred cylindrical expanded shape.

The presence of the slots 3 brings about that the periphery of the cylindrical sleeve 2 can vary within specific limits, with retention of the correct, centred cylinder form, and without permanent deformation of the material of the sleeve 2 occurring.

In a specific embodiment the cylindrical sleeve 2 is made of nickel material with a wall thickness of 200 micrometers and a periphery of 64 cm, slots 3 with a width of 0.05 being present, and a circular perforation with a diameter of 2.6 mm being provided at the ends of each of the slots.

The use of such a slot pattern permits expandability of the cylindrical sleeve in which, for example, a peripheral variation of $\pm 10$ mm can be achieved, without permanent deformation of the material. In this way the peripheral variations desired in certain cases in the cylindrical sleeve belonging to the tensioning roller according to the invention can be achieved in a simple and reproducible manner.

Figure 2A:
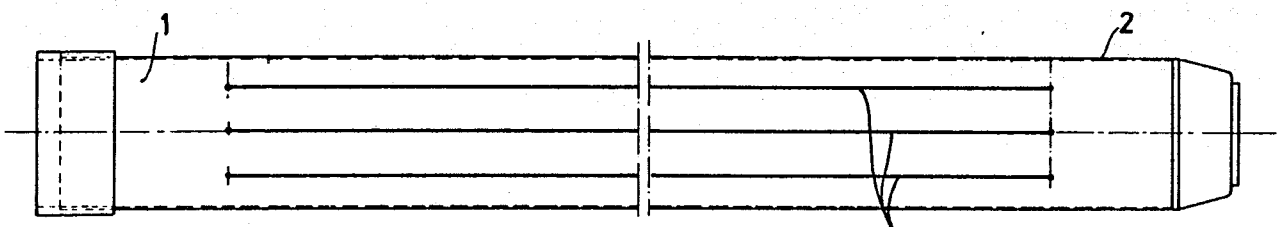
FIGS. 2*a*, 2*b* show two embodiments of a roller according to the invention.
Figure 2B:
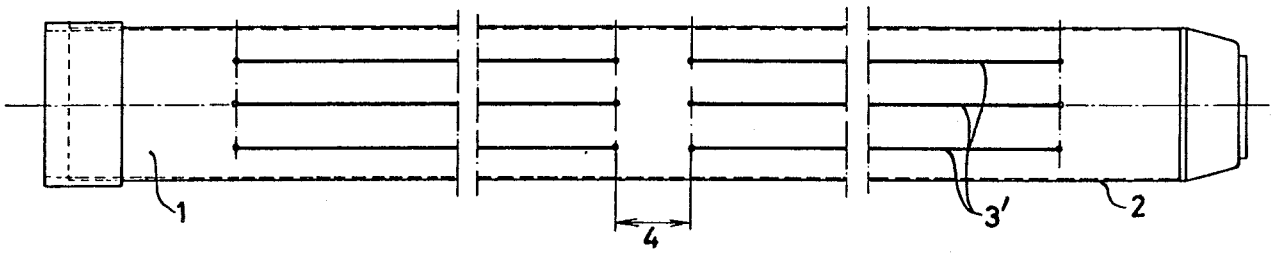

FIGS. 2*a* and 2*b* show two different embodiments of the tensioning roller according to the present invention which merit attention, in particular as regards the design of the slots present.

In FIG. 2*a* the slots extend in the axial direction and are uninterrupted, while in FIG. 2*b* reference number 4 indicates an interrupted area in the slots.

It will be clear that within the scope of the invention the slots pattern used in the cylindrical sleeve can also be in forms other than those shown in FIGS. 2*a* and 2*b*. For example, each slot can have many interruptions, and the slots can be arranged in the rows of slots thus formed so that they are staggered relative to each other.

The slots can also be undulating in nature instead of being straight, and deviations from the purely axial direction of the slots are also permissible.

The tensioning roller according to the present invention is excellent for the above-described laser treatment of rotary screen printing stencils which are sealed up; the tensioning roller can, however also serve extremely well in any exposure device used for exposing, for example, rotary screen printing stencils, and it also provides very good prospects for use in a "film rotation machine".

Other uses of the tensioning roller according to the present invention lie in the field of mechanical processing of surfaces of cylindrical objects such as, for example, engraving, grinding, polishing etc.

What is claimed is:

1. Tensioning roller for centred accommodation during the treating of a medium according to a pattern with high-energy radiation, at least comprising a central shaft around which is placed a supporting element for the medium to be treated, which is expandable in the peripheral direction and in the expanded state is arranged symmetrically round the shaft and, measured in the radial direction going out from the shaft comprises a supporting cylinder, an inflatable bag made of elastic material, a thin-walled metal cylindrical sleeve disposed around it, centring means for centring said supporting cylinder, inflatable bag and cylindrical sleeve, and means for the supply and discharge of inflation medium for the inflatable bag, in which the cylindrical sleeve is provided with slots extending essentially in the axial direction and uniformly distributed in the peripheral direction.

2. Tensioning roller according to claim 1, in which the slots in the cylinder wall extend beyond the maximum width of a medium to be exposed which is to be supported by the cylindrical sleeve.

3. Tensioning roller according to claim 1, in which each of the slots has one or more interruptions.

4. Tensioning roller according to claim 1, in which both ends of each of the slots or parts of slots end in a perforation, the smallest dimension of which is greater than the width of the slot or part of a slot in question.

5. Tensioning roller according to claim 4, in which the perforation is a circular perforation with a diameter for which the following applies:

Width of slot $\leqq$D perforation $\leqq 10\times$Width of slot.

6. Tensioning roller for centred accommodation during the treating of a medium according to a pattern with high-energy radiation, at least comprising a central shaft around which is placed a supporting element for the medium to be treated, which is expandable in the peripheral direction and in the expanded state is arranged symmetrically round the shaft and, measured in the radial direction going out from the shaft comprises a supporting cylinder, an inflatable bag made of elastic material, a thin-walled metal cylindrical sleeve disposed around it, centring means for centring said supporting cylinder, inflatable bag and cylindrical sleeve, and means for the supply and discharge of inflation medium for the inflatable bag, in which the cylindrical sleeve is provided with slots extending essentially in the axial direction and uniformly distributed in the peripheral direction and in which the cylindrical sleeve is of a selected length and is formed by a seamless, electroformed nickel sleeve which has a wall thickness between 100 and 200 μm and has ten slots which are distributed over the periphery thereof, each slot or part of a slot being of a width lying between 50 and 2,000 μm.

7. Tensioning of roller according to claim 6 in which the said slots are interrupted in axial direction to form each a row of multiple slots in said direction.

8. Device for treating a medium according to pattern with high-energy radiation, at least comprising a tensioning roller for carrying the medium to be treated, means for rotary driving of the said tensioning roller, a suitably set-up source of actinic radiation, and means for taking the tensioning roller into the expanded state prior to the exposure to light of the medium, so that said medium comes to rest rotationally symmetrically round the shaft of the tensioning roller, in which the tensioning roller is a tensioning roller for centred accommodation during the treating of said medium according to a pattern with high-energy radiation, at last comprising a central shaft around which is placed a supporting element for the medium to be treated, which is expandable in the peripheral direction and in the expanded state is arranged symmetrically round the shaft and, measured in the radial direction going out from the shaft comprises a supporting cylinder, an inflatable bag made of elastic material, a thin-walled metal cylindrical sleeve disposed around it, centring means for centring said supporting cylinder, inflatable bag and cylindrical sleeve, and means for the supply and discharge of inflation medium for the inflatable bag, wherein the cylindrical sleeve is provided with slots extending essentially in the axial direction and uniformly distributed in the peripheral direction.

* * * * *